United States Patent [19]

Wesley

[11] 4,099,308

[45] Jul. 11, 1978

[54] TURBULENCE GENERATING YARN FEED NEEDLE

[75] Inventor: John Wesley, Wayne, N.J.

[73] Assignee: Celanese Corporation, New York, N.Y.

[21] Appl. No.: 842,027

[22] Filed: Oct. 14, 1977

[51] Int. Cl.[2] ..... D02G 1/16; D02J 1/08

[52] U.S. Cl. ..... 28/273; 57/34 B

[58] Field of Search ..... 28/273, 254, 255, 256, 28/257, 271; 57/34 B, 157 F; 302/25; 226/7, 97

[56] References Cited

U.S. PATENT DOCUMENTS

| | | | |
|---|---|---|---|
| 2,994,938 | 8/1961 | Loveland et al. | 28/273 |
| 3,262,177 | 7/1966 | Cobb et al. | 28/273 X |
| 3,402,446 | 9/1968 | Benson | 28/273 |
| 3,559,860 | 2/1971 | East | 226/97 |

*Primary Examiner*—Louis K. Rimrodt

[57] ABSTRACT

An improved fluid jet bulking device is disclosed in which a yarn feed needle is eccentrically positioned with respect to a venturi and is further provided with a staged means for generation of turbulence in the yarn bulking fluid. The needle may include a flanged end portion which develops a first stage of turbulence generation in the fluid within the venturi inlet, an accelerated flow passage. A second stage of turbulence generation at the distal end of the yarn feed needle augments the level and intensity of turbulence generated in the compressible fluid passing through the device. Fluid flow in the venturi inlet is non-axisymmetric due to the eccentricity so that the successive stages of turbulence generation interact with one another to develop a highly complex turbulent flow regime. The yarn feed needle is preferably constructed such that the turbulent flow generated by the successive stages induces a lateral vibration to the distal end of the needle, thereby creating a non-steady three-dimensional flow. As an alternative to the flanged end porton, a plurality of generally radially extending spokes may be provided at the distal end of the needle to effect a first stage of turbulence generation. In another alternative, a conical surface of the distal end may be provided with suitable scoring marks to further develop turbulent flow in a compressible fluid passing between the yarn feed needle and the venturi.

13 Claims, 5 Drawing Figures

Fig. 1
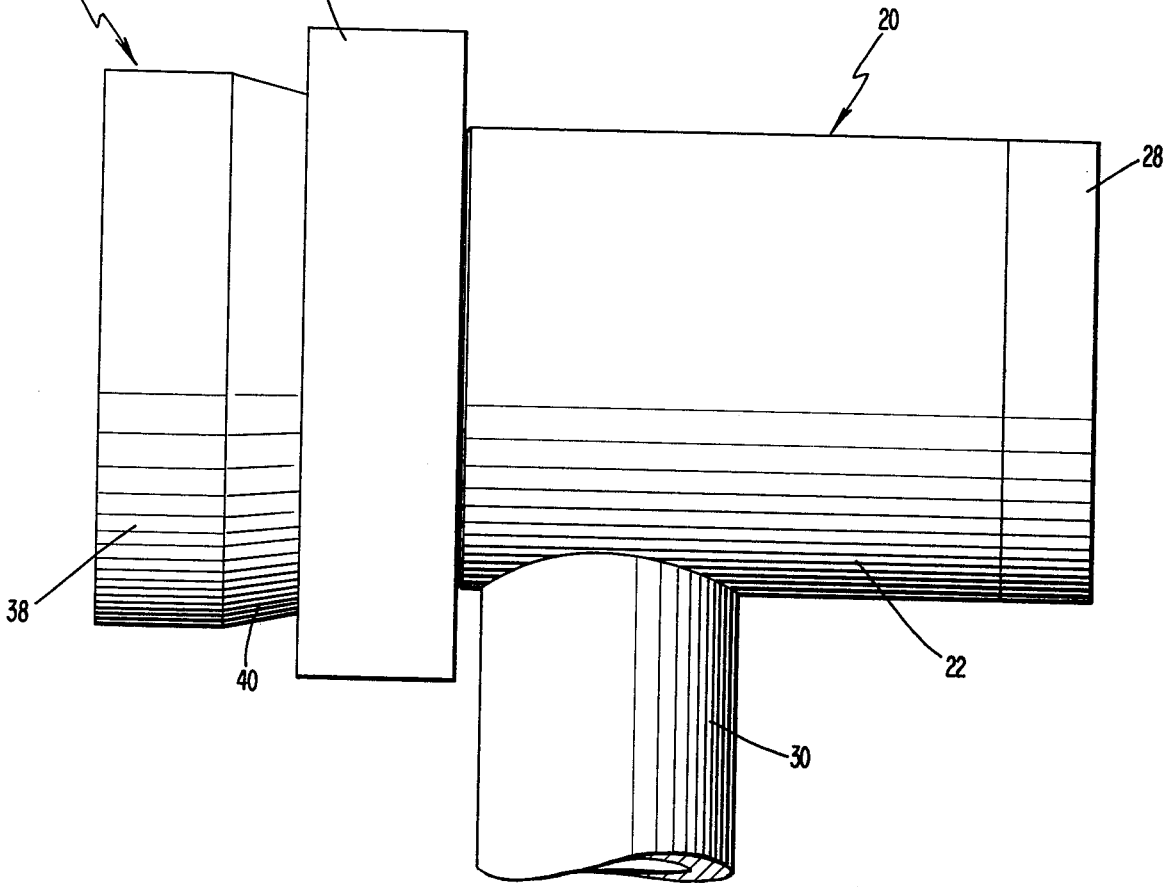
Fig. 4
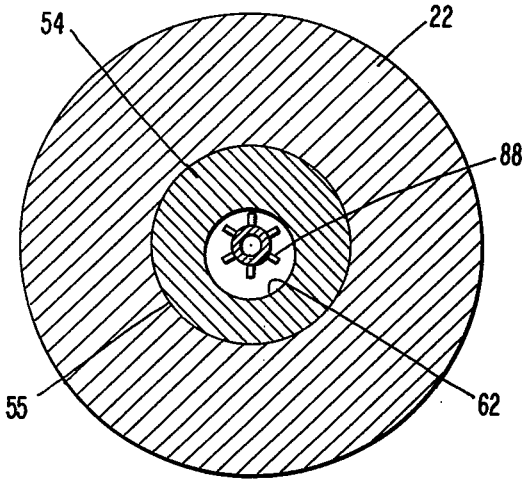
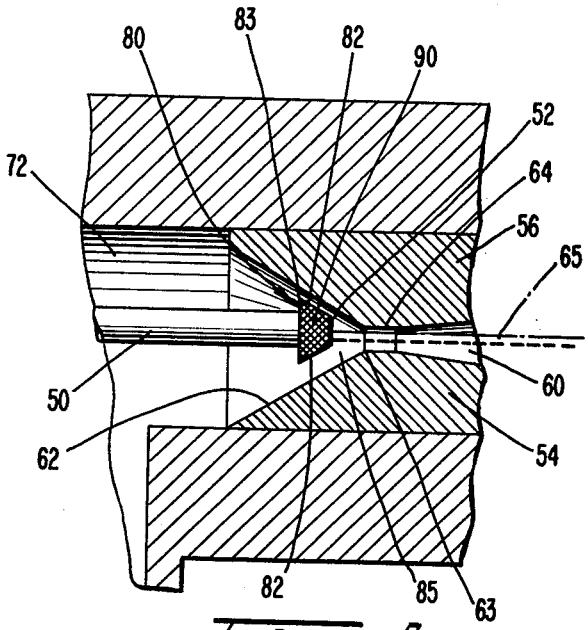
Fig. 5

Fig. 2
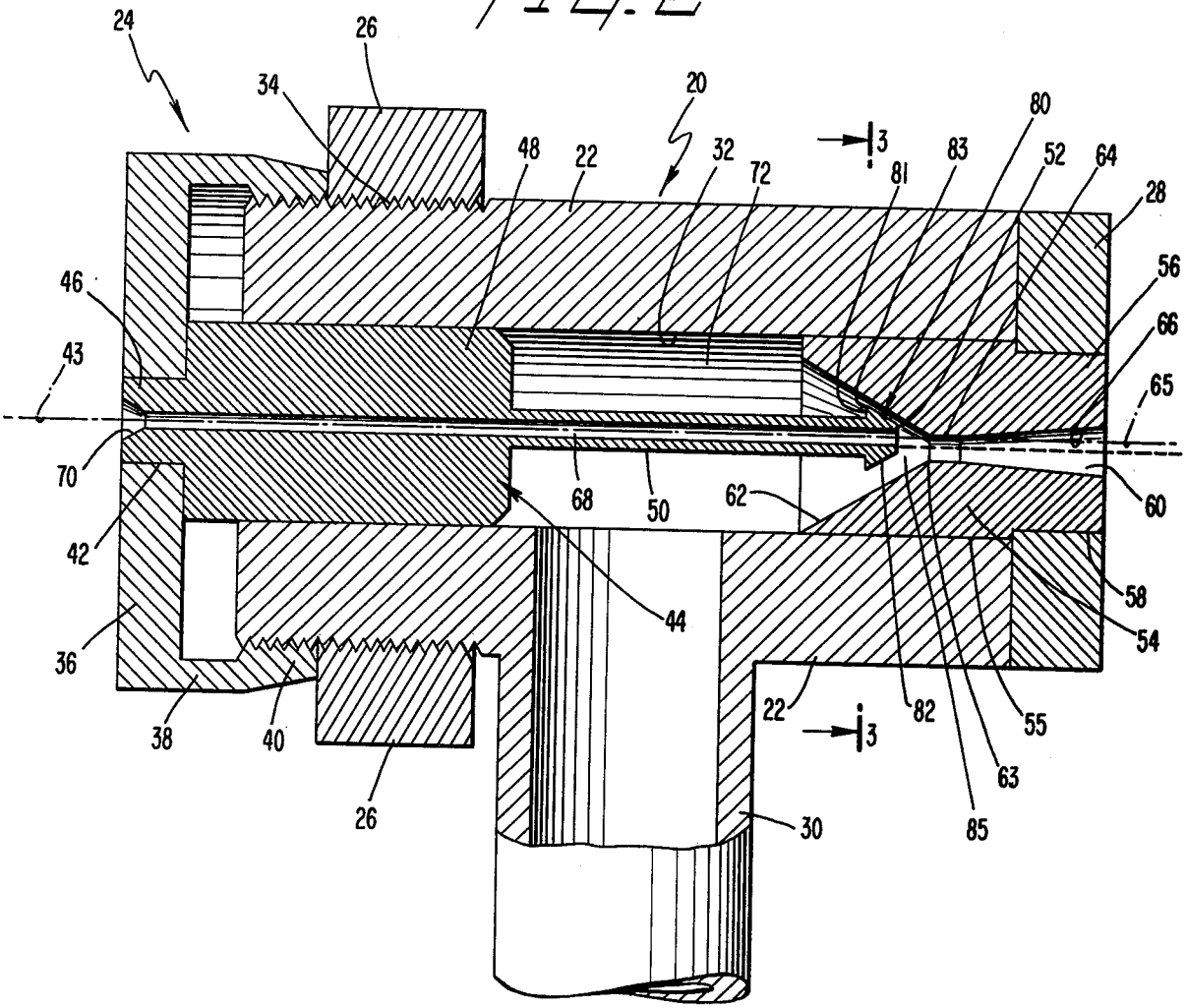
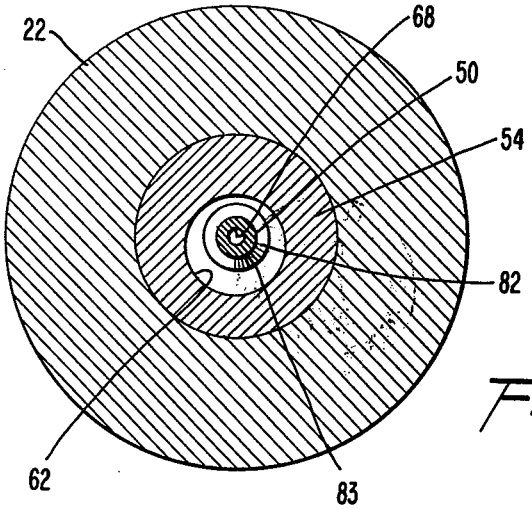
Fig. 3

TURBULENCE GENERATING YARN FEED NEEDLE

BACKGROUND OF THE INVENTION

The present invention relates generally to yarn texturizing devices. More particularly, the present invention concerns an improved fluid jet bulking device and method in which a turbulent compressible fluid flow effects the bulking of a multi-filament yarn.

Fluid jet bulking of multi-filament yarns has long been known in the art. In one common method of fluid jet bulking, a compressible fluid passes coaxially into intimate association with an untextured yarn, and texturizes the yarn. The yarn and the fluid then exhaust from a common outlet. Typically, a yarn feed needle is provided which includes a longitudinally extending bore through which the multi-filament untextured yarn is supplied in an essentially continuous manner. The yarn feed needle is usually contained within a housing having an inlet connected with the supply of pressurized compressible fluid and having a discharge opening through which both the compressible fluid and the texturized yarn are exhausted. The compressible fluid commingles with the multi-filament yarn adjacent the exhaust opening and, by virtue of turbulence in the compressible fluid, the compressible fluid is effective to texturize and increase the bulk of the multi-filament yarn. See, for example, U.S. Pat. No. 2,982,082, issued on May 2, 1961.

Through the years, various attempts have been made to increase the efficiency of the fluid jet bulking resulting from apparatus as described above. For example, it has been proposed to alter the shape of a turbulence chamber immediately adjacent a discharge opening to thereby enhance the level of turbulence acting to texturize the yarn. See, for example, U.S. Pat. No. 3,863,309, issued Feb. 4, 1975.

In the known devices, turbulence is generated in the pressurized compressible fluid at a single location, that location being where the fluid jet commingles with the untexturized multi-filament yarn. Coincidentally, the velocity of the pressurized fluid at this location tends to be accelerating toward a discharge opening. This accelerating flow field transports turbulence of the fluid downstream at a relatively high rate to the discharge opening. Accordingly, turbulent eddies generated by the known phenomena tend to be transported away from the region of commingling with the yarn with which interaction is intended before the turbulent eddies have an adequate opportunity to fully develop for interaction.

With texturizing devices having turbulence generation at a single location, as disclosed in the prior art, the required mass flow rate of pressurized compressible fluid is unnecessarily high due to the poor efficiency of turbulence generation and the poor utilization of available turbulent energy. When dealing with apparatus used on a commercial scale, such inefficiencies lead to higher production costs and, therefore, more expensive finished products.

While efficient utilization of turbulent energy is one deficiency of the known fluid jet bulking devices, another problem concerns the characteristics of the texturized multi-filament yarn. More particularly, the yarns produced by previously known devices tend to have wild loops which protrude laterally from the texturized yarn. These wild loops, when the yarn is processed to make a textile fabric, exhibit a tendency to snag on adjacent objects causing pulls and the like which can detract from the aesthetic appeal of that fabric as well as from the suitability of using that fabric for certain applications.

In view of the foregoing, it is apparent that the need continues to exist for a fluid jet bulking device which overcomes problems of the type noted and which exhibits an improved turbulence generation and utilization efficiency while improving characteristics of the texturizing yarn.

SUMMARY OF THE INVENTION

An improved jet bulking device which overcomes problems of the type discussed above while increasing the intensity of turbulence at the confluence of pressurized compressible fluid and an untextured multi-filament yarn, preferably includes a yarn feed needle having a longitudinally extending axis and a distal end positioned within the inlet of an eccentrically positioned venturi. The effect of these design features on the fluid dynamics in the jet are not fully understood because of fluid/yarn interference effects. However, the mechanisms believed to be responsible for increased turbulence, based on experiments and analysis of the yarn produced, are discussed below.

The distal end of the venturi includes a first means for generating turbulence in the compressible fluid flow. This first means cooperates with the needle and the eccentric venturi inlet to develop turbulent flow in a non-axisymmetric flow regime. As the turbulent eddies are transported downstream further into the venturi inlet, the eddies enter a second turbulence generating means, immediately upstream of the confluence of the pressurized compressible fluid flow and the untextured multi-filament yarn. In this manner, turbulent eddies are generated in the fluid flow which are permitted to develop while being transported downstream. Moreover, these turbulent eddies pass through the second stage of turbulence generation in a non-axisymmetric flow regime which interact to yield a more intense and homogeneous distribution of turbulent eddies in the fluid.

In addition, the distal end of the needle may be cantilevered from one end of the fluid jet bulking device so as to provide flexibility for the distal end. Moreover, the yarn feed needle may be designed with a cross-sectional configuration which permits vibration of the distal end laterally with respect to the axis and within the venturi inlet so as to develop further unsteadiness in the compressible fluid flow. While the two stages of turbulence generation interact to create a broader and intense spectrum of turbulence, the turbulent intensity and homogeneity of the fluid flow regime are further augmented by the vibratory nature of the yarn feed needle.

In order to effect the two successive stages of turbulence generation, it has been found practical to provide a flanged tip at the distal end of the yarn feed needle within the venturi inlet. The flanged tip may have a frustoconical peripheral surface with a cone angle essentially the same as the cone angle of the venturi inlet so that it cooperates with the venturi inlet to define a converging fluid passage. The yarn feed needle has a cross-sectional dimension substantially less than the maximum dimension of the flanged tip so that a sharp edge is provided over which the compressible fluid must pass. At the downstream end of the frustoconical surface, a second sharp edge in conjunction with the venturi inlet defines a secondary throat from which the compressible fluid issues as an annular conical jet that enters a frustoconical chamber. The untextured multi-filament yarn is also advanced into the frustoconical chamber.

Other devices for generating turbulence may, for example, include a plurality of radially extending spokes equiangularly spaced around the tip of the yarn feed needle so as to develop turbulence upstream of the distal end within the flow accelerating passage defined in the venturi inlet. Similarly, the frustoconical surface at the venturi inlet may be suitably roughened to develop a turbulent flow regime.

BRIEF DESCRIPTION OF THE DRAWINGS

Many objects of the present invention will be apparent to those skilled in the art when this specification is read in conjunction with the drawings wherein like reference numerals have been applied to like elements and wherein:

FIG. 1 is an elevational view of a fluid jet bulking device according to the present invention;

FIG. 2 is a longitudinal cross-sectional view taken through a device of FIG. 1;

FIG. 3 is a partial cross-sectional view taken along the line 3—3 of FIG. 2;

FIG. 4 is a view similar to FIG. 3 illustrating a second embodiment of the turbulence generating apparatus; and FIG. 5 is an enlarged detail view similar to that of FIG. 2 illustrating a third embodiment of the turbulence generating apparatus.

DESCRIPTION OF THE PREFERRED EMBODIMENTS

Depicted in FIG. 1 is a fluid jet bulking device 20 having a housing 22. At an upstream end of the housing 22, a yarn feed needle assembly 24 is threadably attached and is axially positioned relative to the housing by a suitable conventional lock nut 26. At the downstream end of the housing 22 a retaining ring 28 is provided which axially secures a venturi nozzle block in position within the housing. Extending laterally outwardly from a central part of one side of the housing 22 is a conduit 30 which is adapted to be connected in fluid communication with a suitable conventional source of compressible fluid (not shown).

Details of the fluid jet bulking device 20 will now be described in connection with FIG. 2. The housing 22 includes a longitudinally extending bore 32 extending from the upstream end to the downstream end of the housing. Preferably, the bore 32 has a generally circular cross section so that the needle assembly can be rotated during axial adjustment. The upstream end of the housing 22 has suitable conventional external threads 34 which cooperate with and receive mating internal threads of the yarn feed needle assembly 24 and the lock nut 26. These cooperating threads allow axial positioning of the yarn feed needle assembly 24.

The needle assembly 24 includes a generally annular cap portion 36 having a skirt portion 38 extending from a peripheral edge of the cap portion 36 toward the housing 22. A distal end portion 40 of the skirt portion 38 is provided with the internal threads that mate with the external threads 34 of the housing 22.

The cap 36 also includes a central opening 42 which is coaxially aligned with the axis 43 of the bore 32 and the housing 22. The opening 42 receives an end of a yarn feed needle 44. The upstream end of the yarn feed needle 44 has a cylindrical projection 46 which extends through the opening 42 in the cap 36. Since the projection 46 has a diameter conforming to the diameter of the opening 42, there may be a suitable conventional fastening therebetween.

The yarn feed needle 44 also includes a generally cylindrical body portion 48 having a diameter closely corresponding to the diameter of the longitudinal bore 32 so that the body 48 substantially closes the upstream end of the bore. If desired, an additional fluid pressure seal between the yarn feed needle 44 and the bore 32 may be provided peripherally around the body portion 48. By fashioning the body portion 48 with an axial length that exceeds its diameter, the body portion 48, the cap 36 and the housing 22 function as a stable and rigid base from which a needle portion 50 of the yarn feed needle 44 can extend in cantilever fashion.

The needle portion 50 extends from the downstream side of the body portion 48 such that the distal end 52 is axially positioned within a venturi nozzle block 54. As seen in FIG. 2, the needle portion 50 is coaxially positioned in the bore 32. Moreover, the needle portion is constructed and arranged so that the distal end 52 can vibrate in response to forces exerted thereon by a flowing fluid. In this connection, the needle portion 50 is stiff enough that the distal end 52 does not contact the venturi inlet during its oscillations. Extending coaxially through the projection 46, the body portion 48 and the needle portion 50 is a straight yarn feed channel 68 through which an untextured multi-filament yarn is introduced into the fluid jet bulking device 20. A chamfered feed opening 70 may be located at the upstream end of the channel 68 to facilitate introduction of the untextured yarn into the channel 68.

The venturi nozzle block 54 has a cylindrical peripheral surface 55 conforming to the bore 32 as well as a cylindrical extension 56 at its downstream end. The extension 56 is received by a corresponding opening 58 in the retaining member 28. In addition, the extension 56 is coaxial with the axis 43 of the bore 32 and may be fixed to the retaining ring 28 in a suitable manner, if desired. The venturi nozzle block 54 includes a venturi passage 60 having an axis 65 which is eccentric to, or laterally displaced from, the axis 43 of the bore 32. The venturi passage 60 includes an inlet portion 62 at the upstream end which is defined by a generally frustoconical peripheral surface 82. The flange 80 is positioned wholly within the venturi inlet portion 62. An upstream face 81 of the flange may be essentially radial. The upstream face 81 and the peripheral surface intersect at an acute angle along the common edge 83. Preferably, the cone angle of the frustoconical peripheral surface 82 is the same as the cone angle of the venturi inlet 62. In this manner, the annular passage defined between the flange 80 and the venturi inlet 62 experiences a secondary throat at the distal end. This secondary throat has a greater flow area than does the primary throat, i.e., the venturi throat portion 64.

As noted above, the body portion 48 of the needle assembly 44 effects a fluid seal at the upstream end of the housing 22. Similarly, the venturi nozzle block 54 has a diameter closely corresponding to the diameter of the bore 32 so that the venturi nozzle body 54 effects a fluid pressure seal at the downstream end of the bore 32. Accordingly, the needle portion 50 and the bore 32 cooperate to define a generally annular chamber 72. The chamber 72 is in fluid communication with the interior of the supply conduit 30 which admits pressurized compressible fluid to the fluid jet bulking assembly 20. Both air and steam are among the suitable compressible fluids that may be used to effect yarn texturizing.

In operation, an untextured multi-filament yarn is continually advanced through the inlet 70 and into the yarn feed channel 68. The yarn leaves the channel 68, enters a turbulence chamber 85 downstream of the distal end 52 and ultimately leaves through the venturi throat portion 64. A suitable pressurized compressible fluid from the conduit 30 enters the annular chamber 72 and is accelerated as it advances through a converging channel defined between the venturi inlet portion 62 and the needle portion 50 (see FIG. 3). The accelerated fluid passes the distal end 52 (see FIG. 2) of the needle portion 50, enters the turbulence chamber where it interacts with yarn, enters the throat 64 of the venturi nozzle block 54 and is ultimately discharged through the discharge portion 66 along with the texturized yarn.

As the continuously flowing compressible fluid passes the distal end 52 of the needle portion 50, the fluid is accelerated by the abrupt decrease in flow area at the upstream edge 83. This abrupt acceleration in combination with the eccentricity between the needle portion 50 and the venturi inlet destroys axisymmetry in the flow field. Moreover, as the fluid passes the sharp edge 83, turbulence and turbulent eddies are formed for transport to the downstream turbulence chamber 85.

As the turbulence is transported downstream, its turbulence has an opportunity to develop. The now turbulent flow enters the secondary throat at the distal end and flows into the turbulence chamber 85 as an annular jet directed conically inwardly. The velocity distribution of the jet is non-uniform circumferentially in both magnitude and flow direction. Moreover, as the fluid passes the distal end 52, it expands abruptly at the downstream edge to further augment the turbulence level and intensity. In addition, this enhancement or augmentation of the turbulence level and intensity also increases the homogeneity of the turbulence as it occurs where the fluid has a different flow direction and velocity than at the upstream edge 83.

The turbulent fluid in the turbulence chamber interacts with the untexturized multi-filament yarn advancing through the yarn feed passage 68 to the distal end 52 of the yarn feed needle assembly 44. As the untexturized multi-filament yarn is discharged into the venturi inlet, the turbulence generated in the compressible fluid engages the yarn filaments and twists, curls, crimps and intertwines the filaments with one another thereby texturizing the multi-filament yarn enhancing the bulk thereof. The fluid and the texturized multi-filament yarn advance downstream through the venturi throat 64 and discharge from the downstream end thereof.

Reconsidering the flow path of compressible fluid through the device 20, the needle portion 50 and the venturi inlet 62 cooperate to define a passage which gradually decreases in area until the axial location of the flanged portion 80 is reached. At this point, the passage experiences an abrupt decrease in cross-sectional area with a projecting surface 81 which requires some stream lines to negotiate a corner 83 defined by an acute angle. This passage generates a first stage of turbulence in fluid passing through the annular passage surrounding the tip portion of the yarn feed needle 50.

At the downstream end of the needle portion, the cross-sectional area of the flow passage experiences an abrupt enlargement as the needle is no longer restricting a central part of the passage thereby allowing some stream lines to negotiate another abrupt corner and generate a second stage of turbulence. The second corner provides a second means for generating turbulence whereas the sharp upstream edge of the flange portion 80 defines a first means for generating turbulence.

The eccentric position of the needle tip 80 with respect to the axis 65 of the venturi passage 60 generates a non-axisymmetric and highly three-dimensional flow field in the compressible fluid passing the end of the yarn feed needle. This non-axisymmetric flow field causes an interaction between the first and second stages of turbulence generation which enhances the overall level of turbulence as compared to a remotely positioned turbulence generating flow field.

As noted, the needle portion 50 is designed to be flexible. The highly turbulent flow passing the flanged tip 80 excites vibration of the distal end 52 of the needle portion 50 during operation of the device 20. This turbulence induced vibration at the radially enlarged flange 80 of the distal end 52 introduces an unsteadiness to the flow field and introduces further complexity to the three-dimensional flow field existing at the distal end of the needle 50. The combination of the two stages of turbulence generation along with vibrating reed-like distal end 52 of the needle portion 50 cooperate to substantially increase the level and homogeneity of turbulence existing at the distal end 52 of the yarn feed needle for interaction with the untexturized multi-filament yarn being fed through the yarn feed passage 68.

An alternative device for generating the first stage of turbulence at the distal end 52 (see FIG. 4) includes a plurality of radially outwardly extending spokes 88. The spokes 88 extend from a position immediately adjacent the distal end and may be equiangularly positioned around the circumference of the needle portion 50. The spokes 88 cooperate to define a first stage of turbulence generation. The downstream end of the needle portion 50 defining the second stage of turbulence generation which in combination with the vibrating needle enhance the level of turbulence substantially in the venturi inlet passage.

A third alternative is disclosed in FIG. 5 wherein the frustoconical surface 82 of the flange-like projection 80 at the distal end of the yarn feed needle portion 50 is provided with a roughened surface 90 to enhance the level of turbulence in fluid passing through the channel defined between the flange-like tip portion 80 and the inlet 62 of the venturi passage 60.

Due to the substantially increased level of turbulence which is effected in the turbulence chamber by a needle 50 designed in accordance with the present invention, the multi-filament yarn may be advanced through the yarn feed passage 68 at a substantially increased linear velocity and still obtain a product with the same characteristics as are presently available.

In the alternative, the volumetric flow rate of pressurized compressible fluid supplied to the texturizing device 20 through the conduit 30 may be substantially decreased, so that yarn being fed at the current speeds is provided with the same level of texturization using a smaller quantity of texturizing fluid. Accordingly, substantial increases in the efficiency of the device are obtained by providing a turbulence enhancing device such as the flange at the tip of the needle. This efficiency results in reduced operating costs for the device and, therefore, reduced manufacturing cost for the texturized multi-filament yarn product.

In addition to the economic advantages discussed above, the resulting texturized yarn product exhibits a substantially reduced level of the wild loops which manifest themselves as a snagging propensity. Thus, with the yarns texturized in this improved bulking device a significantly lower snagging propensity is obtained.

It should now be apparent that there has been provided, in accordance with the present invention, a new and improved fluid jet bulking assembly and method of operation which overcomes problems of the prior art as discussed above. Moreover, it will be apparent to those skilled in the art that numerous modifications, variations, substitutions and equivalents may be made for the features of the invention as described in the specification. Accordingly, it is expressly intended that all such modifications, variations, substitutions and equivalents which fall within the spirit and scope of the invention, as defined in the appended claims, be embraced thereby.

What is claimed is:

1. In yarn bulking apparatus having a housing with a central axis, an internal cavity, a venturi eccentrically positioned relative to the axis at one end of the housing, a yarn feed opening in a second end of the housing, and means for supplying a pressurized compressible fluid to the internal cavity upstream of the venturi inlet, an improved device for generating turbulence in the venturi inlet comprising:

first means for generating turbulence in the compressible fluid, positioned in the venturi inlet providing a first stage of turbulence generation;

second means for generating turbulence in the compressible fluid, positioned in the venturi inlet downstream of the first means, providing a second stage of turbulence generation; and yarn feed needle cantilevered from an upstream end of the internal cavity, extending coaxially through the internal cavity to the venturi inlet, having a yarn feed passage communicating with the yarn feed opening and extending through the yarn feed needle, the second means for generating turbulence being at a distal end of the yarn feed needle and the first means for generating turbulence being upstream of the distal end.

2. The apparatus of claim 1, wherein the yarn feed needle includes a generally cylindrical shank portion with the yarn feed passage coaxially disposed therethrough, the shank portion having a sufficiently thin wall thickness that turbulence induced by the first and second turbulence generating means at the distal end induces lateral vibration of the distal end.

3. The apparatus of claim 2, wherein the yarn feed needle has a ratio of cantilevered length to needle diameter which permits the distal end to vibrate in response to the turbulence with an amplitude that is less than the minimum radial clearance between the distal end and the venturi inlet.

4. The apparatus of claim 1, wherein the first means for generating turbulence includes a generally circular disc at the distal end, having a frustoconical peripheral surface, the peripheral surface defining an acute angle along its common edge with the upstream face of the disc.

5. The apparatus of claim 4, wherein the frustoconical surface has a cone angle corresponding to the cone angle of the venturi inlet so as to provide radial clearance around the disc which is essentially variant in the axial direction.

6. The apparatus of claim 1, wherein the first means for generating turbulence includes a plurality of outwardly extending spokes which induce turbulent eddies in gas passing between the yarn feed needle and the venturi inlet.

7. The apparatus of claim 6, wherein each spoke extends radially outwardly from the yarn feed needle and the plurality of spokes are substantially equiangularly spaced.

8. The apparatus of claim 1, wherein the first means for generating turbulence includes a roughened peripheral surface at the distal end of the yarn feed needle.

9. The apparatus of claim 8, wherein the roughened surface includes a plurality of scored grooves.

10. The apparatus of claim 1, wherein the second means for generating turbulence includes an abrupt flow area enlargement at the distal end of the yarn feed needle.

11. A method of bulking a multi-filament yarn comprising the steps of:

supplying a multi-filament yarn to a yarn feed needle of a bulking device;

supplying a flow of compressible fluid to a fluid channel extending through the bulking device, the channel having a generally annular portion surrounding the yarn feed needle;

accelerating the compressible fluid by directing the fluid as an annular flow into an eccentrically positioned venturi inlet;

abruptly contracting the annular flow portion within the venturi inlet to generate turbulence and a three-dimensional flow field;

abruptly enlarging the annular flow portion to a generally cylindrical flow regime at the downstream end of the yarn feed needle to further increase the turbulence level in the fluid;

passing the multifilament yarn into the turbulent compressible fluid so as to texturize the yarn; and passing the texturized yarn and the turbulent fluid through a venturi throat.

12. The method of claim 11, including the further step of:

expanding the fluid in the venturi exit so as to decrease fluid velocity and reduce tension exerted by the fluid on the yarn.

13. The method of claim 11, wherein the steps of abruptly enlarging and abruptly decreasing generate turbulence having sufficient intensity to vibrate the yarn feed needle within the venturi inlet and thereby induce an unsteady flow field therearound.

* * * * *